US007575099B2

(12) United States Patent
Oh et al.

(10) Patent No.: US 7,575,099 B2
(45) Date of Patent: Aug. 18, 2009

(54) REMOTELY RESETTABLE ROPELESS EMERGENCY STOPPING DEVICE FOR AN ELEVATOR

(75) Inventors: Jae-Hyuk Oh, Tolland, CT (US); Robin Mihekun Miller, Ellington, CT (US); Richard E. Peruggi, Glastonbury, CT (US); Samuel Wan, Simsbury, CT (US); Anthony Cooney, Unionville, CT (US); Adriana Bacellar, Glastonbury, CT (US); Pei-Yuan Peng, Ellington, CT (US)

(73) Assignee: Otis Elevator Company, Farmington, CT (US)

( * ) Notice: Subject to any disclaimer, the term of this patent is extended or adjusted under 35 U.S.C. 154(b) by 557 days.

(21) Appl. No.: 10/575,139

(22) PCT Filed: Oct. 7, 2003

(86) PCT No.: PCT/US03/31551

§ 371 (c)(1),
(2), (4) Date: Apr. 7, 2006

(87) PCT Pub. No.: WO2005/044709

PCT Pub. Date: May 19, 2005

(65) Prior Publication Data

US 2007/0051563 A1 Mar. 8, 2007

(51) Int. Cl.
*B66B 5/06* (2006.01)

(52) U.S. Cl. ..... 187/286; 187/247; 187/287; 187/288; 187/372; 187/373; 187/375; 187/376

(58) Field of Classification Search ..... 187/286, 187/247, 372, 375, 391, 305, 287, 288, 376, 187/373, 346, 359
See application file for complete search history.

(56) References Cited

U.S. PATENT DOCUMENTS 3,762,512 A * 10/1973 McIntyre ..... 188/189

(Continued)

OTHER PUBLICATIONS

International Search Report dated Oct. 19, 2004.

(Continued)

*Primary Examiner*—Bentsu Ro
*Assistant Examiner*—Kawing Chan
(74) *Attorney, Agent, or Firm*—Carlson, Gaskey & Olds

(57) ABSTRACT

A brake mechanism (10) for an elevator (2) is activated in response to an electronic control signal to prevent movement of an elevator car (16) under predetermined conditions. The brake mechanism is preferably a safety mechanism (10) and does not require a governor sheave, a governor rope, or a tension sheave. The safety mechanism in one disclosed example utilizes a solenoid actuator (22*b*) and an electric motor (40) and gear box assembly (42) to move safety wedges (18) into engagement with a guide rail (20) to stop the elevator car (16). The safety wedges (18) are held in a non-deployed position during normal elevator operation. If there is a power loss or if elevator car speed exceeds a predetermined threshold, an electronic control signal activates the safety mechanism (10) causing the solenoid to release, which causes the safety wedges (18) move in a direction opposite to that of a safety housing (12) mounted for movement with the elevator car (16). Angled surfaces of the safety housing (12) force the safety wedges (18) into engagement with the guide rail (20). The safety mechanism (10) can be selectively reset from a remote location.

22 Claims, 5 Drawing Sheets

U.S. PATENT DOCUMENTS

| | | | | | |
|---|---|---|---|---|---|
| 4,518,153 | A | * | 5/1985 | West et al. | 254/274 |
| 5,096,020 | A | * | 3/1992 | Korhonen | 187/376 |
| 5,159,995 | A | * | 11/1992 | Sissala et al. | 187/376 |
| 5,234,079 | A | * | 8/1993 | Nomura | 187/250 |
| 5,353,895 | A | | 10/1994 | Camack | |
| 5,366,045 | A | * | 11/1994 | Liston | 187/376 |
| 5,386,889 | A | * | 2/1995 | Pipes | 188/67 |
| 5,513,760 | A | * | 5/1996 | Luebke | 212/313 |
| 5,819,879 | A | * | 10/1998 | Lang et al. | 187/376 |
| 6,161,653 | A | * | 12/2000 | Skalski et al. | 187/305 |
| 6,202,795 | B1 | | 3/2001 | Bluteau | |
| 6,269,910 | B1 | | 8/2001 | Fargo | |
| 6,318,507 | B1 | | 11/2001 | Jin | |
| 6,371,261 | B1 | * | 4/2002 | Thompson et al. | 188/250 G |
| 6,719,101 | B2 | * | 4/2004 | Hugel | 187/376 |
| 2003/0085078 | A1 | * | 5/2003 | Simmonds et al. | 187/373 |

OTHER PUBLICATIONS

Written Opinion from the International Preliminary Examining Authority dated Aug. 25, 2005.

Notification of Transmittal of IPER from the Int'l Preliminary Examining Authority, Feb. 9, 2006.

* cited by examiner

REMOTELY RESETTABLE ROPELESS EMERGENCY STOPPING DEVICE FOR AN ELEVATOR

FIELD OF THE INVENTION

This invention generally relates to an electrically controlled braking device for an elevator system. More particularly, this invention relates to a ropeless and sheaveless remotely resettable emergency stopping device for an elevator.

DESCRIPTION OF THE RELEVANT ART

Elevators include a safety system to stop an elevator from traveling at excessive speeds in response to an elevator component breaking or otherwise becoming inoperative. Traditionally, elevator safety systems include a speed sensing device typically referred to as a governor, a governor rope, safeties or clamping mechanisms that are mounted to the elevator car frame for selectively gripping elevator guide rails, and a tension sheave located in an elevator pit. The governor includes a governor sheave located in a machine room, which is positioned above the elevator. The governor rope is attached to travel with the elevator car and makes a complete loop around the governor sheave and the tension sheave.

The governor rope is connected to the safeties through mechanical linkages and lift rods. The safeties include brake pads that are mounted for movement with the governor rope and brake housings that are mounted for movement with the elevator car. If the hoist ropes break or other elevator operational components fail, causing the elevator car to travel at an excessive speed, the governor then releases a clutch that grips the governor rope. Thus, the rope is stopped from moving while the elevator car continues to move downwardly. The brake pads, which are connected to the rope, move upwardly while the brake housings move downwardly with the elevator car. The brake housings are wedge shaped, such that as the brake pads are moved in a direction opposite from the brake housings, the brake pads are forced into frictional contact with the guide rails. Eventually the brake pads become wedged between the guide rails and the brake housing such that there is no relative movement between the elevator car and the guide rails.

Limiting springs support the brake housings, which regulate the normal force applied against the rails, and thus regulate the frictional forces generated between the brake pads and the guide rails. The governor rope holds the brake pads so that the frictional force between the brake pads and the guide rails remain over a predetermined threshold until the system can be reset.

To reset the safety system, the brake housing (i.e., the elevator car) must be moved upward while the governor rope is simultaneously released from the clutch. This returns the brake pads to their original positions.

One disadvantage with this traditional safety system is that the installation of the sheaves, rope, and governor is very time consuming. Another disadvantage is the significant number of components that are required to effectively operate the system. The governor sheave assembly, governor rope, and tension sheave assembly are costly and take up a significant amount of space within the hoistway, pit, and machine room. Also, the operation of the governor rope and sheave assemblies generates a significant amount of noise, which is undesirable. Further, the high number of components and moving parts increases maintenance costs. These disadvantages have an even greater impact in modern high-speed elevators.

This invention is an improved safety system that is remotely resettable and eliminates dependency on the governor, rope, and tension devices to avoid the difficulties mentioned above.

SUMMARY OF THE INVENTION

In general terms, this invention is a brake system for an elevator that includes a stopping mechanism that responds to an electronic control signal to prevent movement of an elevator car within a hoistway under selected conditions. A speed sensor continuously monitors elevator speed. An elevator control generates the electronic control signal based on the elevator speed. The inventive safety system does not require a governor sheave, governor rope, or tension sheave. Further, the emergency stopping mechanism is selectively resettable from a remote location. Preferably, the stopping mechanism is utilized in an elevator safety system and comprises an emergency stopping mechanism.

In one disclosed embodiment, the emergency stopping mechanism includes safety wedges positioned on opposing sides of a guide rail. A safety housing is fixed for movement with the elevator car. The safety housing cooperates with the safety wedges to apply a braking force to the guide rail when the safety wedges are moved from a non-deployed position to a deployed position. A first latching device holds the safety wedges in the non-deployed position and a second latching device locks the safety wedges in the deployed position. Springs are associated with each of the safety wedges to move the safety wedges from the non-deployed position to the deployed position once the first latching device is released in response to the electronic control signal from a system actuator.

In another example, the emergency stopping mechanism utilizes a solenoid actuator to deploy the safety wedges. The solenoid actuator includes an electric motor, electromagnet, linear screw, and gear box. A carrier plate is connected to the springs with a connector member. The electromagnet holds the carrier plate, with the springs in a compressed condition, in place during non-deployed operation. When the safety system is activated, the electromagnet releases the carrier plate and the springs move the safety wedges into contact with the guide rail to stop the elevator car.

When the system receives a reset signal, the gear and motor work together to move the electromagnet into engagement with the carrier plate. The electromagnet is then energized to connect the carrier plate to the motor with sufficient force to compress the springs. The motor and gear box then pull the electromagnet and the carrier plate back into the non-deployed position with the springs being held in a compressed condition.

The subject safety system decreases the equipment costs and installation time. Further, the system requires less maintenance due to fewer cycles and wearing parts, and provides faster stops in high rise applications. The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENTS

Figure 1:
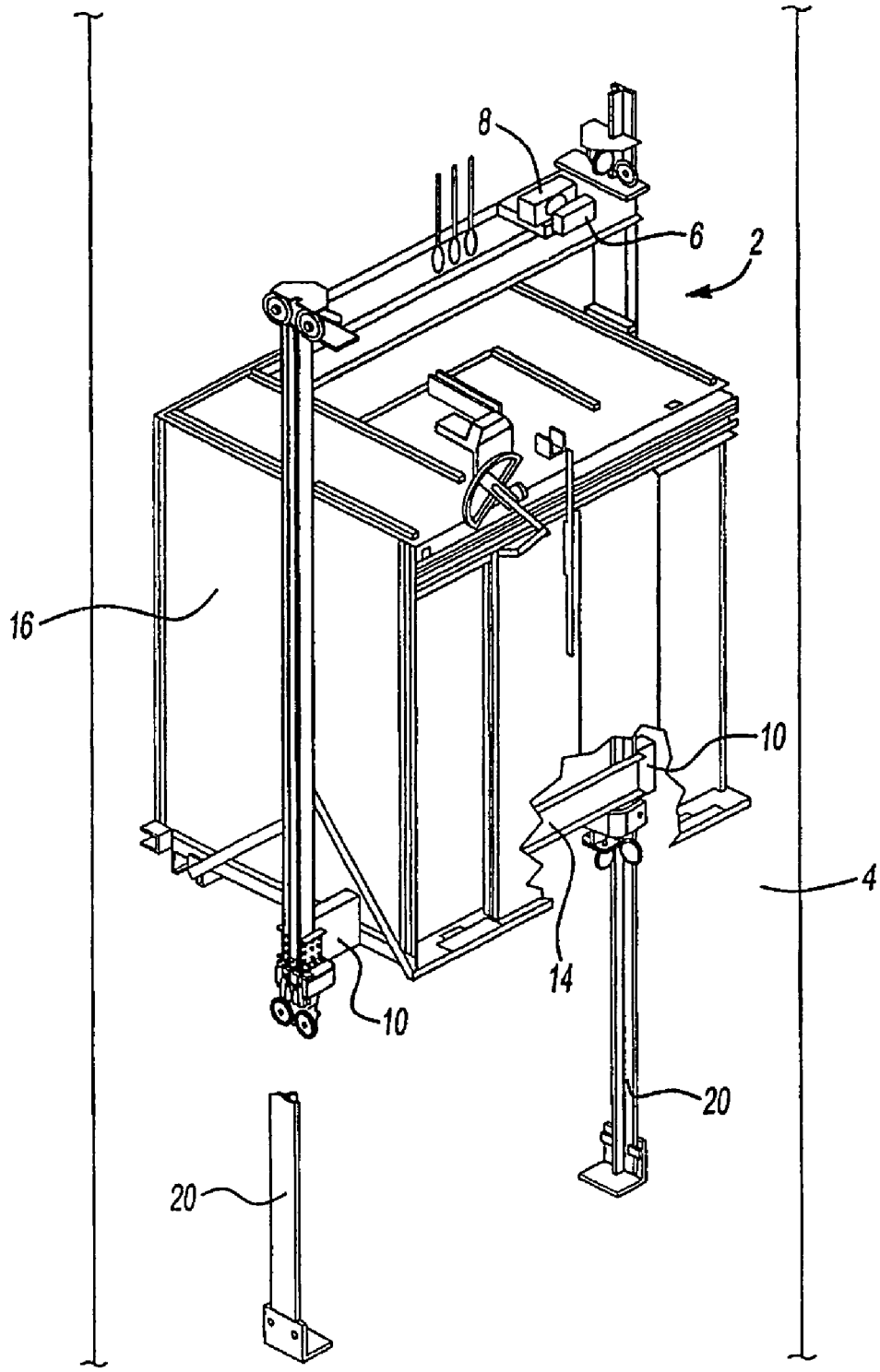
FIG. 1 schematically illustrates an elevator with an elevator safety mechanism incorporating the subject invention.

An elevator assembly 2, shown in FIG. 1, is mounted for movement within a hoistway 4. The elevator assembly 2 includes a speed sensor 6 that continuously measures the speed of the elevator assembly 2. The sensor 6 communicates with an elevator control 8, which generates control signals for controlling movement of the elevator assembly 2. Any type of speed sensor known in the art could be used to monitor elevator speed. The control 8 also communicates with an elevator brake system 10. The brake system 10 includes a unique configuration that can be incorporated into various different types of elevator brakes. In one example, the elevator brake system 10 comprises an elevator safety brake system that stops the elevator 2 from traveling at excessive speeds.

Figure 2:
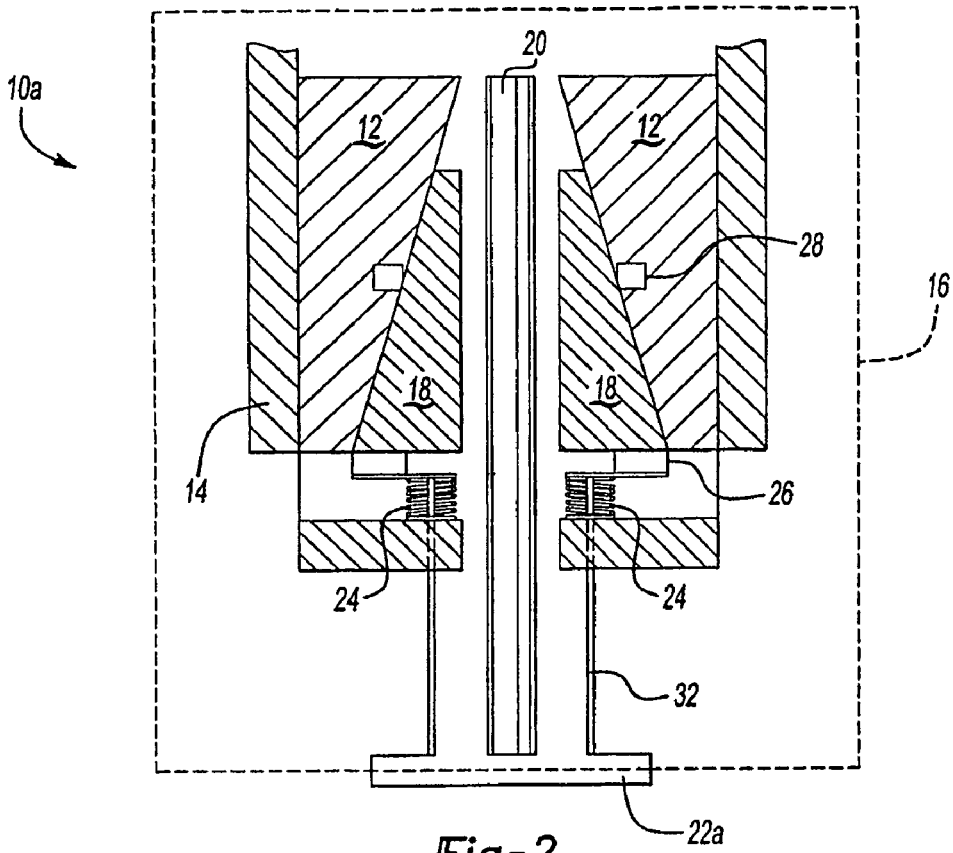
FIG. 2 schematically illustrates one example of the elevator safety mechanism in a non-applied position.

As seen in FIG. 2, one example of the elevator safety brake system is shown generally at 10*a*. The elevator safety brake system 10*a* includes a safety housing 12 that is connected to an elevator car frame 14. Thus, movement of the safety housing 12 corresponds to movement of an elevator car 16. Safety wedges 18 are positioned on opposing sides of a guide rail 20 and are normally spaced apart from the guide rail 20 to allow free movement during normal elevator operation.

Figure 3:
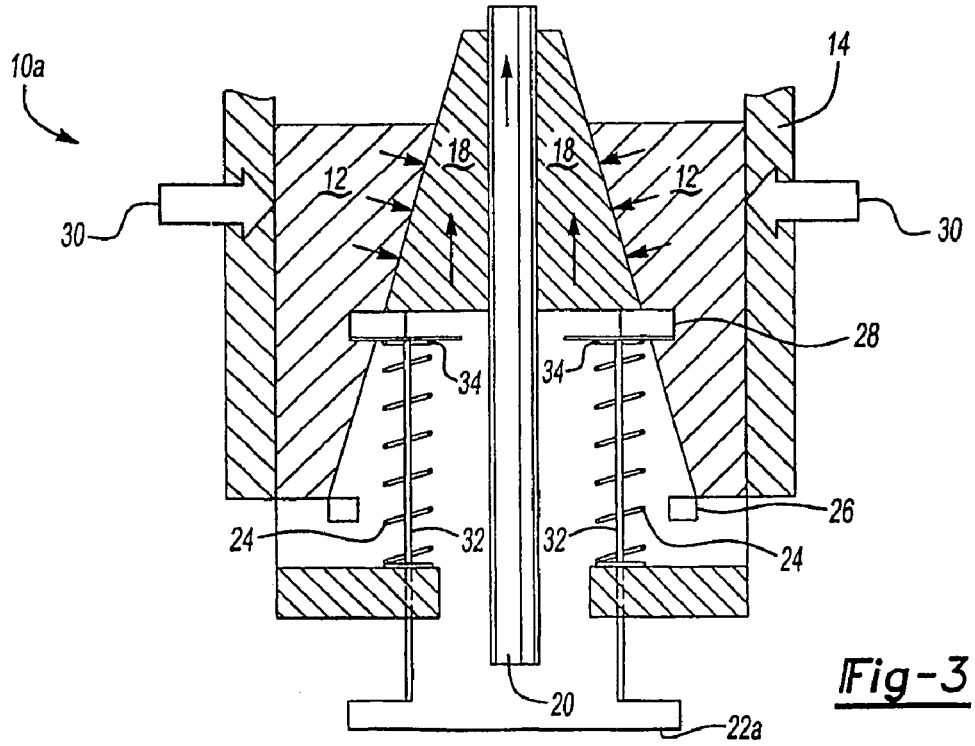
FIG. 3 schematically illustrates the elevator safety mechanism of FIG. 2 in an applied position.

The control 8 includes an actuator 22*a* that moves the safety wedges 18 from a deployed or braking position, as shown in FIG. 3, to a non-deployed or non-braking position as shown in FIG. 2. Any type of known actuator 22*a* can be used to move the safety wedges 18. For example, the actuator 22*a* can comprise a linear actuator such as a screw drive or solenoid.

A spring 24 is associated with each safety wedge 18 to move the wedges 18 from the non-deployed to the deployed position. A first holding or latching device 26 holds the safety wedges 18 in the non-deployed position and a second holding or latching device 28 holds the safety wedges 18 in the deployed position. In one example, the first 26 and second 28 latching devices are solenoids, however, other holding or latching devices could also be used including mechanical and electrical devices.

As shown in FIG. 2, the springs 24 are positioned under the safety wedges 18 in a compressed condition and are latched into place by the first latching device 26. Once the first latching device 26 is deployed (i.e., retracted from engagement with the spring ends), then the springs 24 extend upwardly to move the safety wedges 18 relative to the safety housing 12 and into engagement with the guide rail 20. The safety wedges 18 move upwardly until the safety wedges 18 are latched by the second latching device 28. This latching action can be powerlessly performed by using a spring (not shown) in the solenoid that biases an arm of the solenoid into the position shown in FIG. 3.

As shown in FIG. 3, once the safety wedges 18 are latched into place by the second latching device 28, the conventional normal force limiting springs shown schematically at 30, which support the safety housing 12, are compressed and the friction between the wedges 18 and the rail 20 remains essentially constant over a predetermined threshold value.

Figure 4:
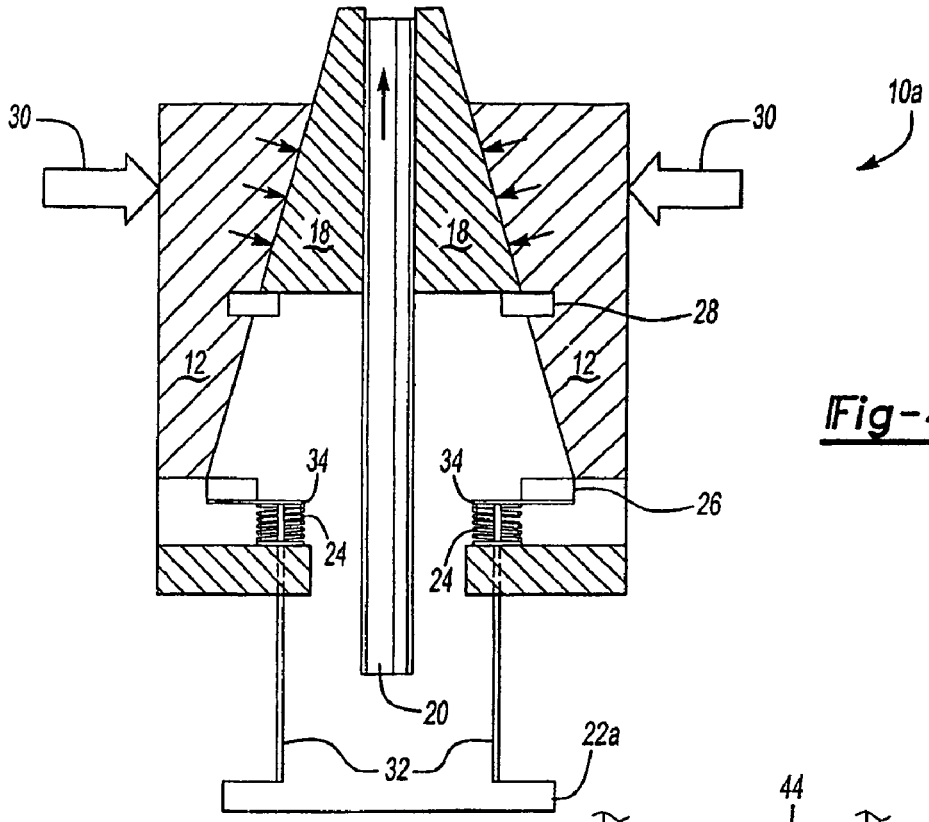
FIG. 4 schematically illustrates the elevator safety mechanism of FIGS. 2 and 3 in a reset position.

Once the elevator car 16 has stopped, the actuator 22*a* can be activated to reset the springs 24, as shown in FIG. 4. A connector 32 interconnects the actuator 22*a* to each spring end 34. The connector 32 preferably comprises a steel shaft, however, other similar connectors such as a wire and tape, for example, could also be used.

While the safety wedges are waiting to be deployed, or during deployment, the connectors 32 preferably are disengaged from the actuator 22*a* so that the safety wedges 18 move without any resistant force from the connectors 32. Once the safety wedges 18 are latched by the second latching device 28, the connectors 32 should automatically engage the actuator 22*a*. When the spring 24 is being reset by the actuator 22*a*, once the spring 24 passes the first latching device 26, the connectors 32 preferably are automatically disengaged from the actuator 22*a*. These functional requirements can be satisfied by spring-latch based mechanisms or by using additional actuators.

Once the spring 24 is reset, the entire safety system 10 can be reset by first resetting the second latch device 28 and subsequently moving the safety housings 12 upwardly. Low-power actuators can be used as the preferred solenoid latching devices because they are used only for latching and the actuator 22*a* includes drive components that do not require fast actuator operation, because the recovery process from the stop can be performed slowly.

Figure 5:
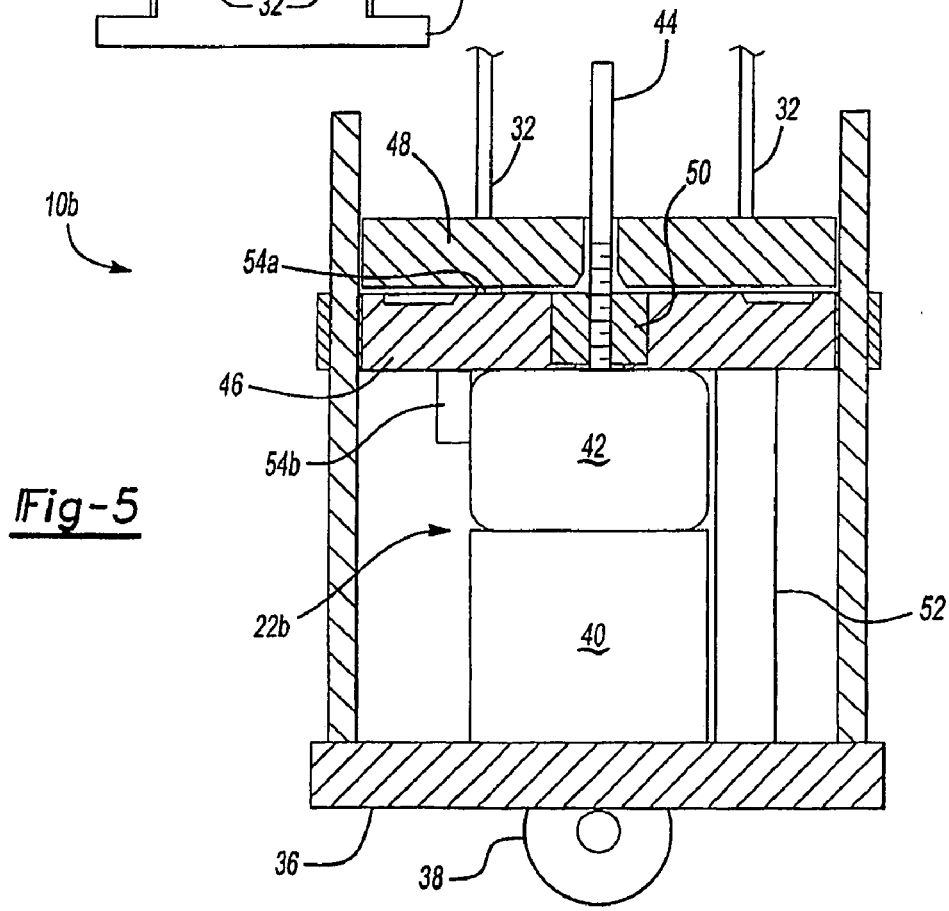
FIG. 5 schematically illustrates another example of an elevator safety mechanism incorporating the subject invention.

Another example of an elevator safety brake system is shown generally at 10*b* in FIG. 5. This configuration utilizes the safety housing 12, wedges 18, springs 24, and connectors 32 as described above. This configuration further includes a solenoid actuation system 22*b* with a mounting plate 36, a clevis 38 for attachment of the plate 36 to the car frame 14 (FIG. 1), an electric motor 40 mounted to the mounting plate 36, and a gear box 42 that is operably coupled to the motor 40. The gear box 42 drives a linear screw 44, such as a ball screw or jackscrew. The actuator 22*b* also includes an electromagnet 46 and a carrier plate 48 that is attached to the connectors 32. A nut 50 is received within the electromagnet 46 to engage the linear screw 44. The nut 50 is fixed for movement with the electromagnet 46. Wires 52 extend between the mounting plate 36 and electromagnet 46 and are operably connected to a power source (not shown) to selectively power the magnet 46. The system 10*b* also includes at least two engagement sensors 54*a*, 54*b* to monitor movement of the electromagnet 46 and carrier plate 48, which will be discussed in greater detail below.

This configuration provides rapid actuation of the safety brake system 10*b* in a failsafe manner and provides resetting of the safety brake system 10*b* in a manner in which the safety wedges 18 are always ready for actuation. Resetting of the wedges 18 can be a slow operation, thus permitting the use of small and cost effective motors and gear boxes. The actuator 22*b* operates directly against the full actuation spring force of the safety wedges 18 to minimize the number of components and to reduce complexity of the system 10*b*.

The gear box 42 preferably includes planetary gearing for a narrow actuator package or worm gearing for a flatter and reduced cost system, however, other gear configurations could also be used.

Figure 6:
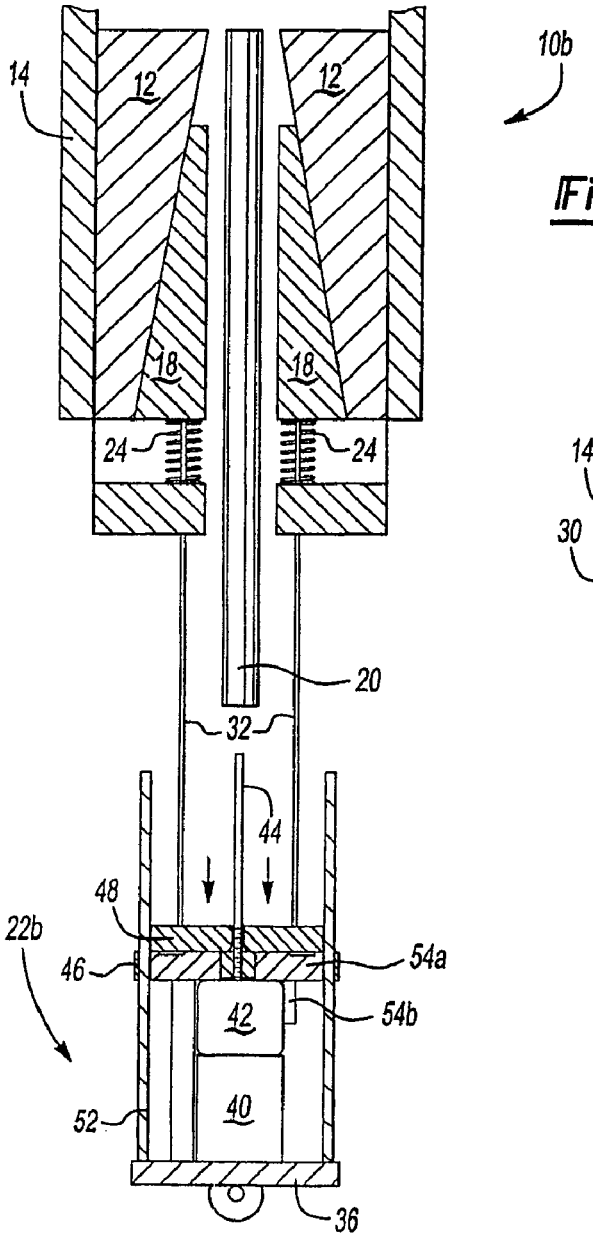
FIG. 6 schematically illustrates the mechanism of FIG. 5 in a ready to deploy position.

FIGS. 6-9 show operation of the safety system 10*b* and actuator 22*b* from an initial non-deployed position to a system reset position. In FIG. 6, the system 10*b* is in a ready state. The failsafe springs 24 are fully compressed and the electromagnet 46 is holding the spring 24 in position with the carrier plate 48. If there is a loss of power or if elevator car 16 (FIG. 1) speed exceeds a predetermined threshold, the system 10*b* is activated.

Figure 7:
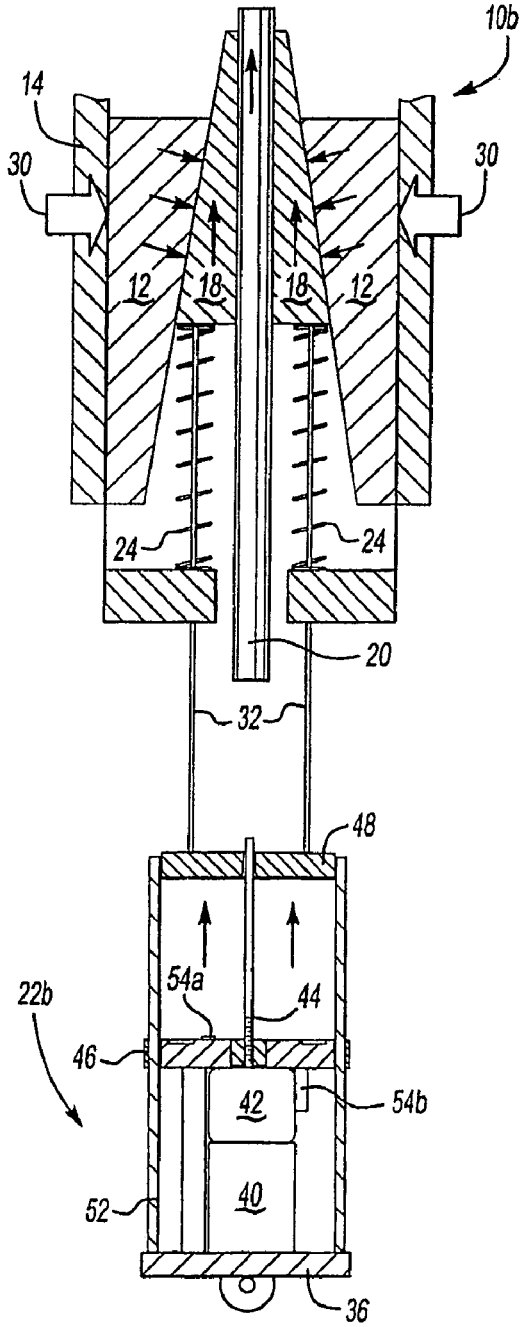
FIG. 7 schematically illustrates the elevator safety mechanism of FIG. 6 in a deployed position.
Figure 8:
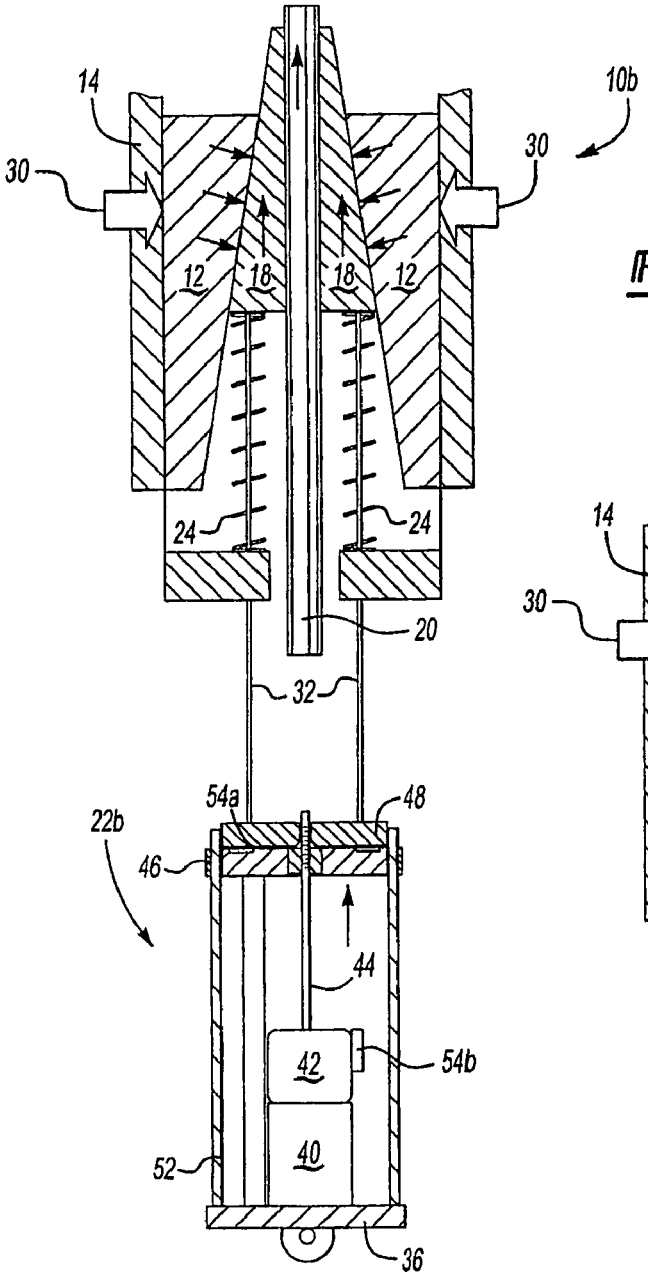
FIG. 8 schematically illustrates the elevator safety mechanism of FIG. 6 in a re-engagement position prior to system reset.

As shown in FIG. 7, the electromagnet 46 releases the carrier plate 48 and the springs 24 accelerate the safety wedges 18 into contact with the rail 20. This compresses the normal force limiting springs 30, resulting in constant friction between the wedges 18 and the rail 20 to hold the wedges 18 in the deployed or locked position. When an electronic reset signal is received, as shown in FIG. 8, the motor 40 and gear box 42 are activated to drive the electromagnet 46 into contact with the carrier plate 48. The electromagnet 46 is energized to connect the carrier plate 48 to the actuator 22*b* such that the linear screw can compress the springs 24 to release the safety wedges 18. The connection is verified with one of the engagement sensors 54*a*.

Figure 9:
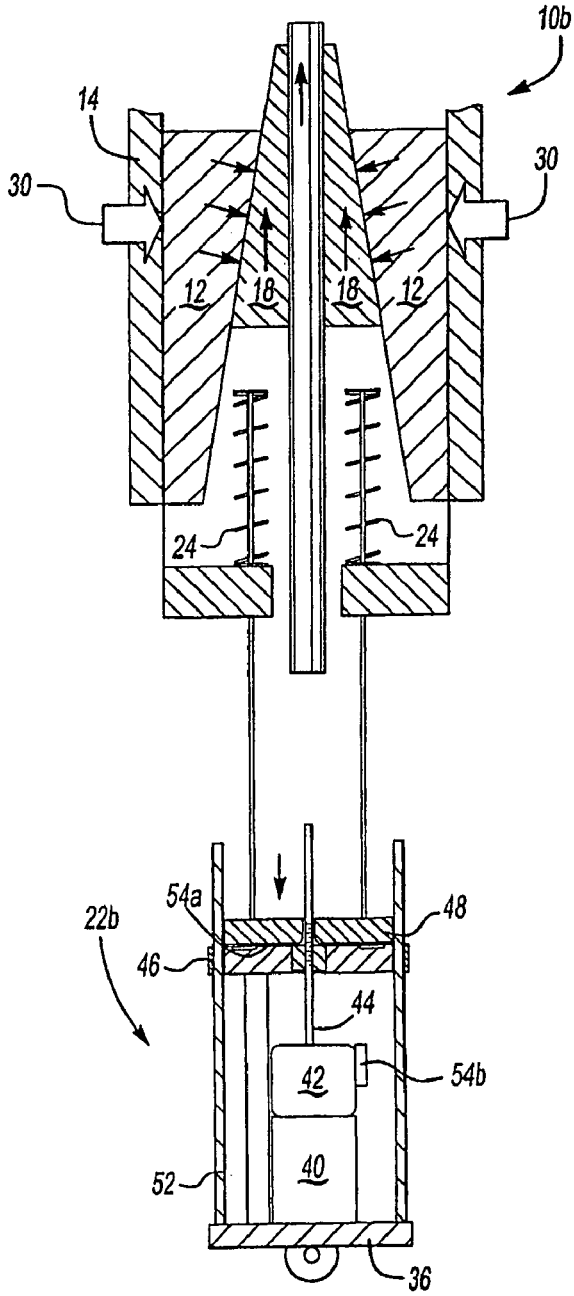
FIG. 9 schematically illustrates the elevator safety mechanism of FIG. 6 in a system recovery position occurring during system reset.

During reset, as shown in FIG. 9, the motor 40 and gear box 42 pull the electromagnet 46 and carrier 48 back into the ready state with the linear screw 44, compressing the springs 24. The other engagement sensor 52*b* indicates when the electromagnet 46 has returned to its initial, non-deployed position. At any time during the reset operation, if the safety system 10*b* is required to be re-activated, the electromagnet 46 can release the carrier plate 48 to re-engage the wedges 18 against the rail 20.

It should be understood that the subject invention could be utilized with any known friction braking surface and friction brake members. Thus, the description of safety housings and wedges are merely an example of one type of friction braking surface and friction brake member that could benefit from the subject invention.

This unique system provides several advantages over traditional governor systems. There is lower cost because the traditional governor sheaves and ropes have been eliminated. Noise is also significantly reduced due to the elimination of the sheaves and rope. Maintenance and system costs and downtime are reduced because there are no wearing parts. Also, because the governor rope has been eliminated, there is no rope stretch, thus response time is consistent under all situations. Installation costs are also reduced because equipment no longer needs to be installed in the pit or in the machine room. Finally, the system requires less space in the hoistway which is an advantage for high speed elevator systems.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A brake system for an elevator car comprising:

a ropeless and sheaveless stopping mechanism responsive to an electronic control signal to automatically stop an elevator car under predetermined conditions;

at least one spring for moving said stopping mechanism from a non-deployed position to a deployed position in response to said electronic control signal wherein said at least one spring is resettable from a remote location in response to an electronic reset signal; and an actuator operably coupled to said at least one spring to return said at least one spring and said stopping mechanism to the non-deployed position in response to said electronic reset signal wherein said at least one spring is selectively decoupled from at least one of said stopping mechanism and said actuator.

2. The system of claim 1 wherein said electronic control signal is generated in response to an excessive speed condition when an elevator car speed exceeds a predetermined threshold.

3. The system of claim 2 wherein said stopping mechanism includes at least one set of safety wedges adapted to be positioned on opposing sides of a guide rail and a safety housing that cooperates with said set of safety wedges to apply a braking force to said guide rail when said safety wedges move from the non-deployed position to the deployed position.

4. The system of claim 3 wherein said stopping mechanism includes a first latching device for holding said safety wedges in the non-deployed position, and a second latching device for locking said safety wedges in the deployed position, and wherein said at least one spring is associated with said safety wedges to move said safety wedges from the non-deployed position to the deployed position once said first latching device is released in response to said electronic control signal.

5. The system of claim 4 wherein said first and second latching devices each comprise a solenoid.

6. The system of claim 4 wherein said actuator returns said at least one spring and said safety wedges to the non-deployed position in response to said electronic reset signal.

7. The system of claim 3 wherein said at least one spring comprises a plurality of springs with at least one spring being associated with each of said safety wedges and wherein a connector connects said springs to said actuator that returns said springs to a non-deployed position in response to said electronic reset signal.

8. The system of claim 7 wherein said actuator comprises a carrier plate mounted for movement with said connector, a motor supported by a car frame, a gear box associated with an output of said motor, and an electromagnet coupled to a linear screw driven by said gear box, said carrier plate being selectively coupled with said electromagnet when said screw moves said electromagnet into engagement with said carrier plate to reset said carrier plate after said carrier plate has been deployed.

9. The system of claim 1 including at least one sensor for monitoring elevator car speed, said at least one sensor communicating with an elevator control that generates said electronic control signal for controlling movement of the elevator car, and wherein stopping mechanism comprises an emergency stopping mechanism being responsive to said electronic control signal to automatically stop the elevator car when the elevator car speed exceeds a predetermined threshold speed.

10. The system of claim 1 wherein the elevator car comprises an enclosure that is supported on an elevator frame movable within a hoistway along elevator rails that are positioned on opposite sides of the elevator car, and wherein the stopping mechanism is associated with at least one of the elevator rails.

11. A brake system for an elevator car (16) comprising:

a ropeless and sheaveless stopping mechanism (10) responsive to an electronic control signal to automatically stop an elevator car (16) under predetermined conditions; and at least one spring for moving said stopping mechanism from a non-deployed position to a deployed position in response to said electronic control signal wherein said at least one spring is resettable from a remote location in response to an electronic reset signal, and wherein said electronic control signal is generated in response to an excessive speed condition when an elevator car speed exceeds a predetermined threshold;

at least one set of safety wedges adapted to be positioned on opposing sides of a guide rail and a safety housing that cooperates with said set of safety wedges to apply a braking force to said guide rail when said safety wedges move from the non-deployed position to the deployed position;

said stopping mechanism including a first latching device for holding said safety wedges in the non-deployed position and a second latching device for locking said safety wedges in the deployed position, and wherein said at least one spring is associated with said safety wedges to move said safety wedges from the non-deployed position to the deployed position once said first latching device is released in response to said electronic control signal;

an actuator operably coupled to said at least one spring to return said at least one spring and the safety wedges to the non-deployed position in response to said electronic reset signal; and a connector for connecting the at least one spring to said actuator, wherein said connector is automatically disengaged from said actuator when said safety wedges are in the non-deployed position and is automatically engaged to said actuator when said safety wedges are in the deployed position.

12. A method for activating a braking system for an elevator car comprising the steps of:

(a) identifying a need for an elevator braking operation;

(b) generating an electronic control signal to activate a ropeless and sheaveless stopping mechanism to prevent movement of an elevator car subsequent to step (a);

(c) moving the stopping mechanism from a non-deployed position to a deployed position with at least one spring in response to the electronic control signal;

(d) resetting the at least one spring to a non-deployed position from a remote location in response to an electronic rest signal; and (e) coupling an actuator to the at least one spring to return the at least one spring and the stopping mechanism to the non-deployed position in response to the electronic reset signal wherein the at least one spring is selectively decoupled from at least one of the stopping mechanism and the actuator.

13. The method of claim 12 including the step of generating the electronic control signal in response to an excessive speed condition identified during step (a) when an elevator car speed exceeds a predetermined threshold.

14. The method of claim 12 wherein the stopping mechanism comprises an emergency stopping mechanism and step (a) further includes identifying an undesirable operating condition.

15. The method of claim 14 including the steps of fixing a safety housing for movement with the elevator car, positioning safety wedges on opposing sides of a guide rail, and mounting the safety wedges and housing for movement with the elevator car and wherein step (b) includes moving the safety wedges from the non-deployed position with the at least one spring.

16. The method of claim 15 including the step of forcing the safety wedges into frictional engagement with the guide rail as the safety wedges move from the non-deployed position to the deployed position.

17. The method of claim 16 wherein the at least one spring comprises a plurality of springs, and including the steps of latching the safety wedges in the non-deployed position with a first latch mechanism, coupling at least one spring to each of the safety wedges to move the safety wedges from the non-deployed position to the deployed position once the first latching device is released in response to the electronic control signal, and latching the safety wedges in the deployed position with a second latch mechanism once the first latching mechanism is released.

18. The method of claim 17 including the step of connecting the springs to a linear actuator to return the springs to the non-deployed position in response to the electronic reset signal.

19. The method of claim 16 including the steps of coupling the at least one spring to the safety wedges, mounting a carrier plate for movement with the springs, and controlling movement of the carrier plate with a solenoid actuator.

20. The method of claim 19 including the steps of activating the solenoid actuator to overcome the spring force of the at least one spring by holding the carrier plate and the safety wedges in the non-deployed position with an electromagnet, and releasing the electromagnet from an initial position causing the at least one spring to move the safety wedges into the deployed position in response to identification of an undesirable elevator operating condition.

21. The method of claim 20 including the steps of driving the electromagnet into engagement with the carrier plate in response to the electronic reset signal, activating the electromagnet to couple the carrier plate to the electromagnet, and compressing the at least one spring by moving the carrier plate and electromagnet to the initial position to return the safety wedges to the non-deployed position.

22. The method of claim 21 further including the step of coupling the electromagnet to an electric motor and gear box to control linear movement of the electromagnet.

* * * * *

UNITED STATES PATENT AND TRADEMARK OFFICE

CERTIFICATE OF CORRECTION

PATENT NO. : 7,575,099 B2
APPLICATION NO. : 10/575139
DATED : August 18, 2009
INVENTOR(S) : Oh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 690 days.

Signed and Sealed this

Seventh Day of September, 2010

David J. Kappos

David J. Kappos
*Director of the United States Patent and Trademark Office*